US007027753B2

(12) United States Patent
Suzuki

(10) Patent No.: US 7,027,753 B2
(45) Date of Patent: Apr. 11, 2006

(54) IMAGE FORMING APPARATUS FOR PREVENTING IMAGE DETERIORATION CAUSED BY FALLEN CONDUCTIVE BRUSH AND SCATTER OF DEVELOPER

(75) Inventor: Yuji Suzuki, Tokyo (JP)

(73) Assignee: Ricoh Co., Ltd., Tokyo (JP)

( * ) Notice: Subject to any disclaimer, the term of this patent is extended or adjusted under 35 U.S.C. 154(b) by 14 days.

(21) Appl. No.: 10/821,898

(22) Filed: Apr. 12, 2004

(65) Prior Publication Data

US 2004/0258431 A1 Dec. 23, 2004

(30) Foreign Application Priority Data

Apr. 11, 2003 (JP) ..... 2003-107786
Jul. 17, 2003 (JP) ..... 2003-198662

(51) Int. Cl.
*G03G 15/08* (2006.01)

(52) U.S. Cl. ..... 399/103

(58) Field of Classification Search ..... 399/91, 399/98, 102, 103, 104, 105, 106
See application file for complete search history.

(56) References Cited

U.S. PATENT DOCUMENTS 4,792,831 A 12/1988 Takeda et al.
4,897,693 A 1/1990 Sawayama
6,144,820 A * 11/2000 Ishii et al. ..... 399/90
6,151,467 A * 11/2000 Yamaguchi ..... 399/104
6,700,595 B1 3/2004 Sugiyama et al.
6,792,227 B1 * 9/2004 Itabashi ..... 399/105
2002/0191989 A1 12/2002 Kurosu

FOREIGN PATENT DOCUMENTS

| | | |
|---|---|---|
| EP | 1 229 399 | 8/2002 |
| JP | 10-268639 | 10/1998 |
| JP | 2000-305360 | 11/2000 |
| JP | 2002-221883 | 8/2002 |
| JP | 2002-278287 | 9/2002 |
| JP | 2002-287503 | 10/2002 |
| JP | 2002-287530 | 10/2002 |

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus includes a latent image carrier, a charging member, a conductive brush member that cleans the charging member, a developer carrier including magnetic field generating devices having main and auxiliary magnetic poles, a developer scatter preventing member, and a toner accumulation preventing member. A contact pressure of an end portion of the developer scatter preventing member relative to the latent image carrier is set such that a brush, which falls from the conductive brush member and is carried on the latent image carrier, passes through a contact part between the end portion of the developer scatter preventing member and the latent image carrier. The main magnetic pole has an angular width of about 60 degrees or less between opposite pole transition points respectively positioned upstream and downstream of a flux density of the main magnetic pole in the normal direction in a developer conveying direction.

20 Claims, 9 Drawing Sheets

MAIN MAGNETIC POLE ANGLE OF 0 DEGREE

MAIN MAGNETIC POLE ANGLE OF 6 DEGREES

IMAGE FORMING APPARATUS FOR PREVENTING IMAGE DETERIORATION CAUSED BY FALLEN CONDUCTIVE BRUSH AND SCATTER OF DEVELOPER

CROSS-REFERENCE TO RELATED APPLICATIONS

This application claims priority to Japanese Patent Application No. 2003-107786 filed in the Japanese Patent Office on Apr. 11, 2003, and Japanese Patent Application No. 2003-198662 filed in the Japanese Patent Office on Jul. 17, 2003, the disclosures of which are incorporated herein by reference in their entirety.

BACKGROUND OF THE INVENTION

1. Field of the Invention

The present invention relates to an image forming apparatus, such as a copying machine, a printer, a facsimile machine, or other similar image forming apparatus, and more particularly to an image forming apparatus including a conductive brush member that cleans a surface of a charging member, such as a charging roller, which uniformly charges a surface of a latent image carrier.

2. Discussion of the Related Art

In an image forming apparatus that has been generally used, an electrostatic latent image formed on a latent image carrier is developed as a toner image by a developing device. Subsequently, the toner image is transferred and fixed onto a recording sheet. In this image forming apparatus, a cleaning device including, for example, a cleaning blade, removes residual toner, which has not been transferred from the latent image carrier to the recording sheet, from the latent image carrier. Thereby, the surface of the latent image carrier is prepared for a next image formation.

A surface of a photoreceptor functioning as a latent image carrier is uniformly charged by a charging device. Then, an image writing device irradiates the surface of the photoreceptor with a light and forms an electrostatic latent image on the surface of the photoreceptor. Generally, a charging device that charges the surface of the photoreceptor includes a charging member, such as a charging roller. The charging roller is in contact with or adjacent to the surface of the photoreceptor, and a voltage is applied to a position between the charging roller and the photoreceptor. The charging roller of this type is practically used in view of reduction of ozone and electric power. In this charging device, when foreign substances, such as toner and paper powder, are adhered onto the surface of the charging roller, the charging roller may not uniformly charge the surface of the photoreceptor. Recently, with an increasing demand for enhancing an image quality and resolution, a toner having a small particle diameter has been often used in a development process. However, the toner having a small particle diameter typically causes a cleaning failure in which a cleaning device may not adequately remove the toner from the surface of the photoreceptor. In this condition, residual toner remaining on the surface of the photoreceptor adheres to the above-described charging roller, so that the charging roller may not uniformly charge the surface of the photoreceptor. To address this problem, Published Japanese patent application No. 2002-221883 describes a cleaning device that removes foreign substances from a surface of a charging roller by use of a brush roller.

As a developing device that develops an electrostatic latent image formed on a photoreceptor with a developer, a so-called two-component type developing device is generally used. In the two-component type developing device, a developer carrier carries a two-component developer (hereafter referred to as a "developer") including toner and magnetic carrier thereon. An electrostatic latent image formed on a photoreceptor is developed by forming a magnetic brush including magnetic carrier holding toner on the surface of the developer carrier by the action of a fixed magnetic pole in the developer carrier.

Further, in the two-component type developing device, a developer regulating member, such as a doctor blade, regulates a layer thickness of the developer carried on the developer carrier. The developer having a predetermined layer thickness is conveyed to a developing region where the developer carrier faces the photoreceptor by the movement of the surface of the developer carrier. At this time, the magnetic carrier and toner may scatter by the influence of a centrifugal force exerted on the developer and an airflow in the developing device (hereafter referred to as a "developer scatter"). Especially, if carrier and toner having small particle diameters are used, a developer scatter tends to occur. To prevent the developer scatter, a developer scatter preventing member is provided to cover a developer layer that has passed the developer regulating position where a developer regulating member regulates the layer thickness of the developer carried on the developer carrier. For example, Published Japanese patent application Nos. 2002-278287 and 2002-287503 describe a developing device in which a developer scatter preventing member is provided.

FIG. 1 is a schematic view of a background developer scatter preventing member 110*a*. Referring to FIG. 1, one end of a developer scatter preventing member 110*a* is fixed onto an edge portion of a casing (not shown) to cover a developer layer D which is deposited on a developing roller 141 functioning as a developer carrier and which has passed a position where a developer regulating member (not shown), such as a doctor blade, regulates a layer thickness of the developer on the developing roller 141. The casing has an opening exposing a portion of the developing roller 141 and has the edge portion adjoining the opening. Further, the developer scatter preventing member 110*a* is flexed such that another end of the developer scatter preventing member 110*a* contacts a surface of a photoreceptor 101 to block a gap between the edge portion of the casing and the surface of the photoreceptor 101. With this configuration, the developer scatter preventing member 110*a* can prevent the developer from scattering at the position on an upstream side of a developing region where the developing roller 141 faces the photoreceptor 101, in a direction of conveying the developer (hereafter referred to as a "developer conveying direction").

For example, Published Japanese patent application No. 10-268639 describes an image forming apparatus including an elastic sheet like the above-described developer scatter preventing member 110*a* and elastic seal members to block a gap between a photoconductive drum and a developer carrier. The elastic seal members press-contact non-image formation areas on respective outer circumferential surfaces of the photoconductive drum and the developer carrier, which are respectively located on both end portions of the photoconductive drum and the developer carrier in each of rotation shaft directions of the photoconductive drum and the developer carrier. With this configuration, the elastic sheet prevents a developer from scattering at the position on an upstream side of a developing region in a developer conveying direction, and the elastic seal members prevent the developer from scattering from the both end portions of the developer carrier.

The developer scatter preventing member 110*a* can prevent the developer from scattering from the developer layer (D) on the developing roller 141 in an early period. However, as the number of image formations increases, toner (T) adheres to a surface (hereafter referred to as a "rear surface") of the developer scatter preventing member 110*a* facing the developer layer (D), so that the toner (T) accumulates on the rear surface of the developer scatter preventing member 110*a* (hereafter referred to as "accumulation of toner"). The accumulation of toner, that is, agglomeration of toner, falls to the developing region immediately after the start of rotation of the developing roller 141 and when an impulse is given to the agglomeration of toner in an image formation process. If the agglomeration of toner adheres to a non-image area and an image area on the photoreceptor 101, an output image is stained. Further, a partial omission of an output image may occur due to a poor transfer efficiency of the agglomeration of toner and disturbance of a transfer electric field around the agglomeration of toner. Moreover, if toner, which has passed through the developing region, accumulates on a sheet conveying guide, a transfer sheet may be stained. Further, if toner accumulates on the rear surface of the developer scatter preventing member 110*a*, the position of the developer scatter preventing member 110*a* may shift due to the weight of the agglomeration of toner. Thereby, a contact pressure of the developer scatter preventing member 110*a* against the surface of the photoreceptor 101 changes. The developer may consequently leak out from the portion of the developer scatter preventing member 110*a* which contacts the surface of the photoreceptor 101 with low pressure. The leaked developer may scatter from the developing device.

If a magnetic brush including magnetic carrier holding toner rises by the action of a magnetic pole in the developing roller 141 at the most downstream position of the developer scatter preventing member 110*a* in the developer conveying direction, the risen magnetic brush pushes the most downstream portion (i.e., the leading edge portion) of the developer scatter preventing member 110*a*. If the developer scatter preventing member 110*a* is located above the developing region as shown in FIG. 1, the leading edge portion of the developer scatter preventing member 110*a* is pressed upward by the pushing force of the risen magnetic brush. In this condition, the friction between the pushed-up leading edge portion of the developer scatter preventing member 110*a* and the surface of the photoreceptor 101 may cause damage to the surface of the photoreceptor 101, an abnormal image such as a black streak image, and a cleaning failure. Above all, the edge portion of the developer scatter preventing member 110*a* is significantly pushed up by the risen magnetic brush. Therefore, a gap is formed between the edge portion of the developer scatter preventing member 110*a* and the surface of the photoreceptor 101. The developer may scatter from the developing device through the gap formed between the edge portion of the developer scatter preventing member 110*a* and the surface of the photoreceptor 101.

Further, the present inventor found that an image may be deteriorated when a brush roller is used as a cleaning device that cleans a surface of the above-described harging member. The cause of the deterioration of an image is considered as follows.

When removing foreign substances adhered onto a surface of a charging member by a brush roller, the cleaning ability of the brush roller is enhanced by use of an electrostatic force. Most of the foreign substances adhered onto the surface of the charging member are charged with an opposite polarity to that of a charging bias applied to the charging member. For these reasons, a conductive brush roller is often used as a cleaning device. The potential of the conductive brush roller may have a polarity equal to that of a charging bias applied to the charging member, and thereby the conductive brush roller may mechanically and electrostatically remove the foreign substances, which are charged with an opposite polarity to that of the potential of the conductive brush roller, from the surface of the charging member. When using a brush roller for a long period of time, a brush of the brush roller may fall from a core metal portion of the brush roller, and the fallen brush may be adhered onto a surface of a photoreceptor via the charging roller. In this condition, the fallen brush may be conveyed to a position where a developer scatter preventing member contacts the surface of the photoreceptor by the movement of the surface of the photoreceptor, and may stay at the position with the fallen brush sandwiched between the developer scatter preventing member and the surface of the photoreceptor. The brush, which is sandwiched between the developer scatter preventing member and the surface of the photoreceptor, contacts a magnetic brush in a developing region, and the charge on the photoreceptor is leaked to the magnetic brush via the fallen brush. As a result, an electrostatic latent image formed on the surface of the photoreceptor may be distorted, resulting in a deterioration of image quality.

In order to prevent the developer scatter by the developer scatter preventing member, it is preferable that the surface of the leading edge portion of the developer scatter preventing member is brought into intimate contact with the surface of the photoreceptor. However, in this condition, the above-described fallen brush may not pass through the developer scatter preventing member and tends to be sandwiched between the surface of the photoreceptor and the developer scatter preventing member. As a result, an electrostatic latent image formed on the surface of the photoreceptor may be disturbed.

Therefore, the present inventor determined it is desirable to provide an image forming apparatus in which a high quality image can be formed by preventing an image deterioration caused by a fallen conductive brush and by controlling a developer scatter over a long time period.

SUMMARY OF THE INVENTION

According to an aspect of the present invention, an image forming apparatus includes a latent image carrier configured to carry a latent image on a surface of the latent image carrier while moving, and a charging member configured to uniformly charge the surface of the latent image carrier. The charging member is one of in contact with and adjacent to the surface of the latent image carrier. The image forming apparatus further includes a conductive brush member including a brush configured to remove foreign substances from the surface of the charging member, and a developing device configured to develop the latent image carried on the surface of the latent image carrier with toner. The developing device includes a developer carrier configured to carry a developer including the toner on a surface of the developer carrier while moving, and a casing configured to accommodate the developer carrier, the casing having an opening exposing a portion of the developer carrier, and having an edge portion adjoining the opening. The image forming apparatus further includes a developer scatter preventing member configured to prevent the developer from scattering. The surface of the developer carrier exposed through the opening of the casing faces the surface of the latent image carrier in a developing region. A first end portion of the developer scatter preventing member is fixed to the edge portion of the casing and a second end portion of the developer scatter preventing member is flexed on an upstream side of the developing region in a moving direction of the surface of the latent image carrier, and a gap between the edge portion of the casing and the surface of the latent image carrier is blocked by bringing the second end portion of the developer scatter preventing member into contact with the surface of the latent image carrier. A contact pressure of the second end portion of the developer scatter preventing member relative to the surface of the latent image carrier is set such that a brush, which falls from the conductive brush member and is carried on the surface of the latent image carrier, passes through a contact part between the second end portion of the developer scatter preventing member and the surface of the latent image carrier.

According to another aspect of the present invention, an image forming apparatus includes a latent image carrier configured to carry a latent image on a surface of the latent image carrier, and a charging member configured to uniformly charge the surface of the latent image carrier. The charging member is one of in contact with and adjacent to the surface of the latent image carrier. The image forming apparatus further includes a conductive brush member including a brush configured to remove foreign substances from the surface of the charging member, and a developing device configured to develop the latent image carried on the surface of the latent image carrier with toner. The developing device includes a developer carrier configured to carry a two-component developer including the toner and magnetic carrier on a surface of the developer carrier and disposed opposite to the surface of the latent image carrier. The developer carrier includes a rotary non-magnetic sleeve, and at least one magnetic field generating device having a main magnetic pole provided inside of the sleeve. The developing device further includes a casing configured to accommodate the developer carrier. The casing has an opening exposing a portion of the developer carrier, and has an edge portion adjoining the opening. The developer carried on the surface of the developer carrier is conveyed to the opening of the casing, and the main magnetic pole causes the developer to deposit and rise on the surface of the developer carrier in a form of a magnetic brush at the opening of the casing, and the toner in the magnetic brush is supplied to the latent image carried on the surface of the latent image carrier. The image forming apparatus further includes a developer scatter preventing member configured to prevent the developer from scattering. The developer scatter preventing member is disposed at the opening of the casing on an upstream side of a region where the magnetic brush rises on the surface of the developer carrier in a direction of conveying the developer on the surface of the developer carrier such that a leading edge of the developer scatter preventing member contacts the surface of the latent image carrier. The image forming apparatus further includes a toner accumulation preventing member configured to prevent the toner from accumulating. The toner accumulation preventing member is disposed between the surface of the developer carrier and the developer scatter preventing member. The at least one magnetic field generating device further includes adjoining auxiliary magnetic poles disposed upstream and downstream of the main magnetic pole in the direction of conveying the developer, respectively, to adjust a half-width of the main magnetic pole. The main magnetic pole has an angular width of about 60 degrees or less between opposite pole transition points respectively positioned upstream and downstream of a flux density of the main magnetic pole in the normal direction to the direction of conveying the developer.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
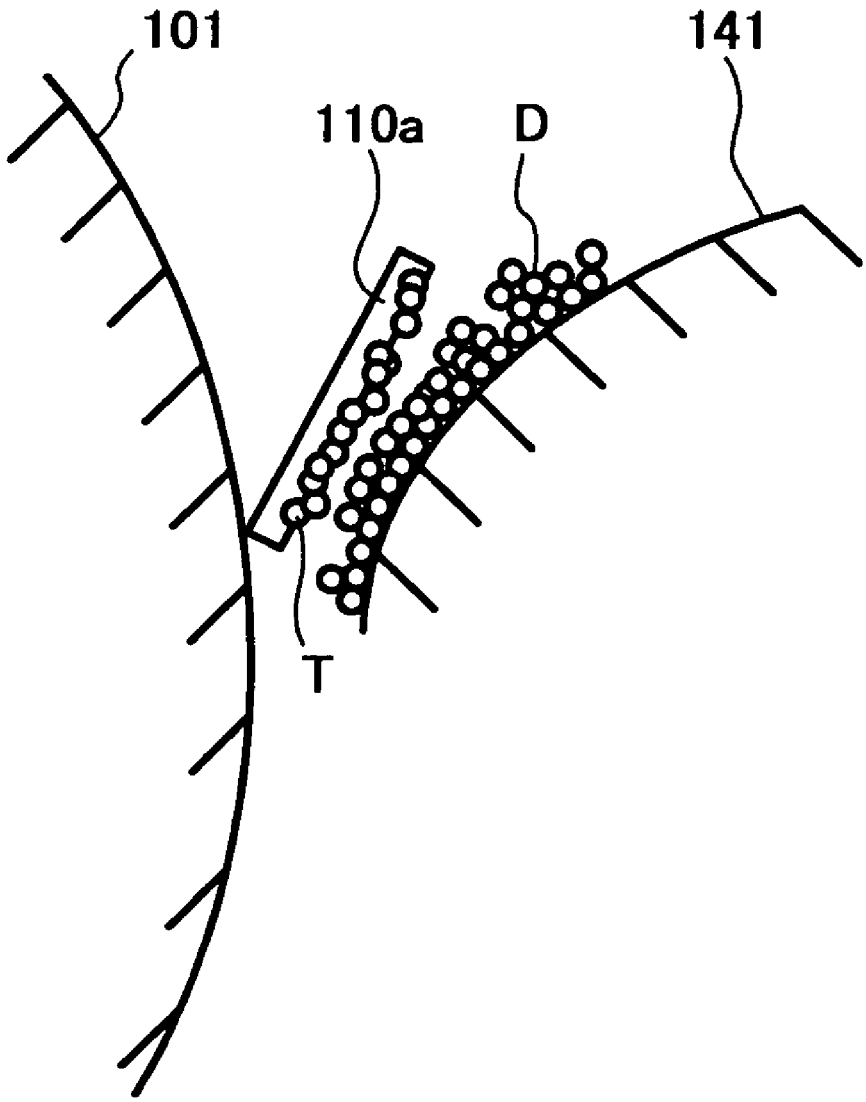
FIG. 1 BACKGROUND ART
FIG. 1 is a schematic view of a background developer scatter preventing member.

Preferred embodiments of the present invention are described in detail referring to the drawings, wherein like reference numerals designate identical or corresponding parts throughout the several views. The present invention is applied to an electrophotographic copying machine as a non-limiting example of an image forming apparatus. In place of the copying machine, a facsimile machine, a printer, or other image forming apparatuses may be applicable. In place of the individual copying machine components, the components of such other image forming appartatuses may be individually applicable as well.

Figure 2:
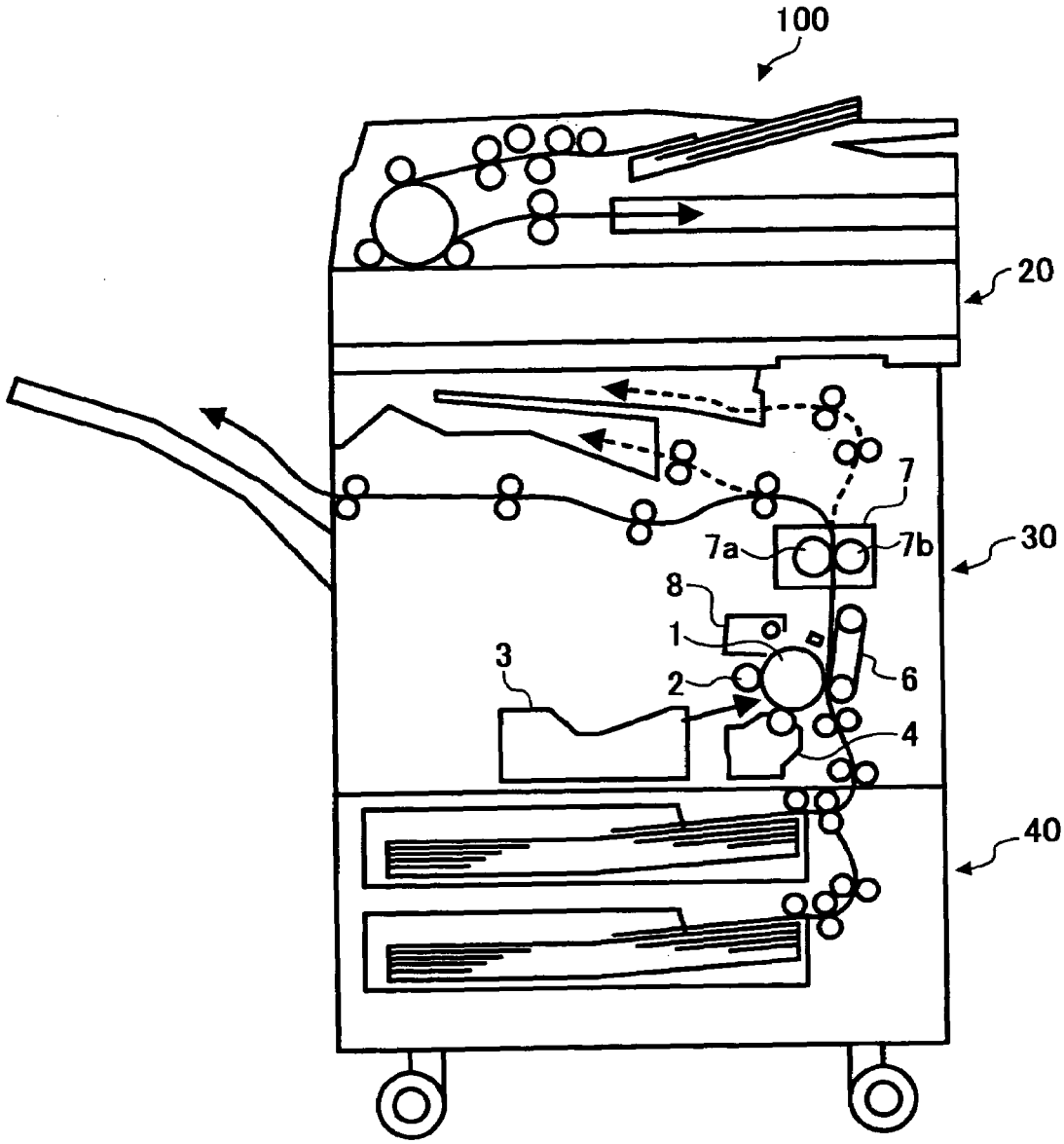
FIG. 2 is a schematic view of an image forming apparatus according to an embodiment of the present invention.

FIG. 2 is a schematic view of a copying machine according to an embodiment of the present invention. In this embodiment, a copying machine 100 forms single-color images. However, the copying machine 100 may form multi-color images.

The copying machine 100 includes a scanner 20, a main body 30, and a sheet feeding device 40. The main body 30 includes a photoconductive drum 1 functioning as a latent image carrier, a charging device 2, an exposing device 3 functioning as a latent image forming device, a developing device 4, a transfer device 6, a fixing device 7, and a cleaning device 8.

Figure 3:
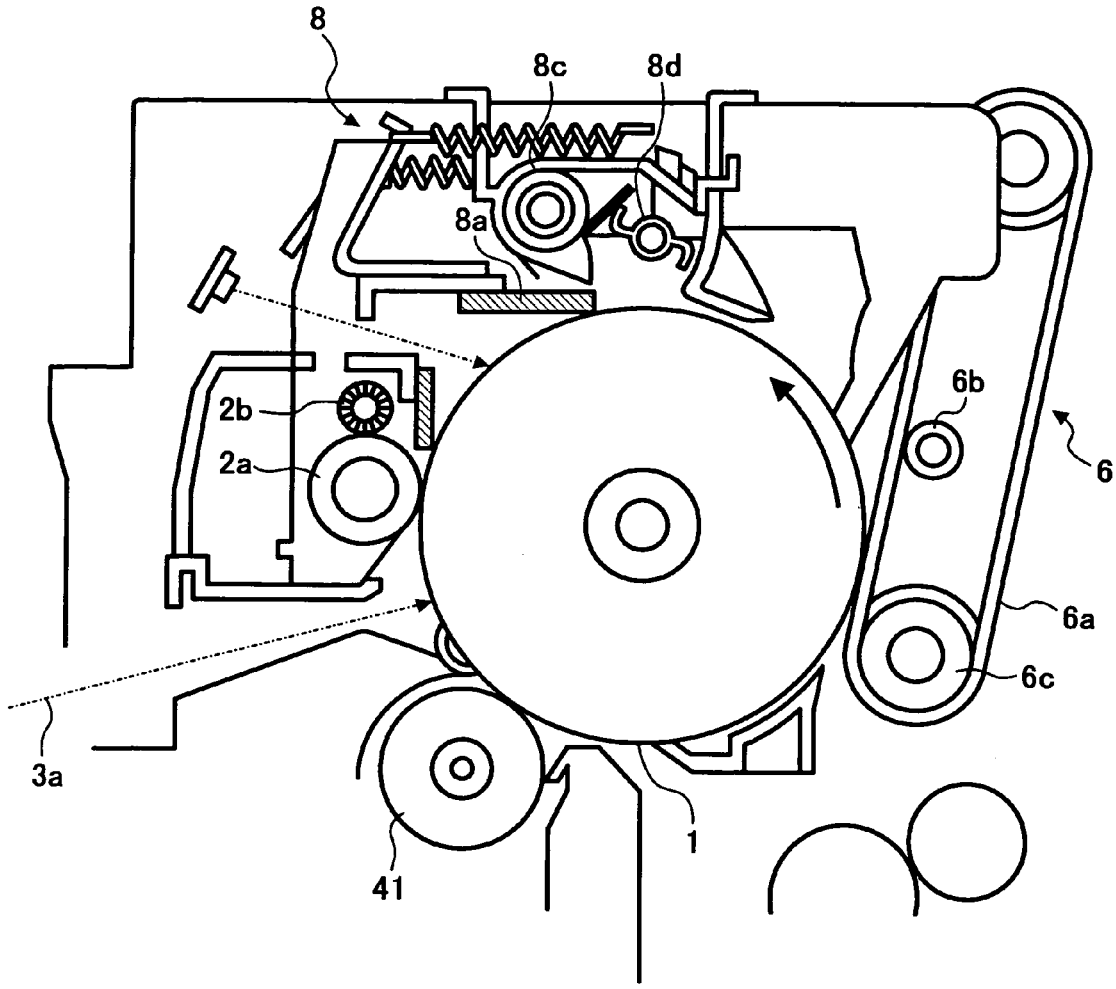
FIG. 3 is an enlarged view of a photoconductive drum and devices around the photoconductive drum according to an embodiment of the present invention.

FIG. 3 is an enlarged view of the photoconductive drum 1 and devices disposed around the photoconductive drum 1. The photoconductive drum 1 includes a photosensitive layer as a surface layer. The photosensitive layer is made of organic compounds, such as photoconductive amorphous silicon, amorphous metal such as amorphous selenium, bisazo pigments, and phthalocyanine pigments. In view of environmental issues and post-processing after use, it is preferable that the photosensitive layer is made of organic compounds.

As shown in FIG. 3, the charging device 2 includes a charging roller 2*a* having an elastic layer at least on an outer periphery of a core metal, and a power source (not shown) connected to the charging roller 2*a*. The charging device 2 is configured to apply a predetermined voltage to a gap between the charging roller 2*a* and the photoconductive drum 1 while applying a high voltage to the charging roller 2*a*. Thereby, a corona discharge is generated between the charging roller 2*a* and the photoconductive drum 1, so that the surface of the photoconductive drum 1 is uniformly charged. The charging device 2 further includes a brush roller 2*b* functioning as a conductive brush member and being in contact with the surface of the charging roller 2*a*. The brush roller 2*b* is configured to remove foreign substances from the surface of the charging roller 2*a* (described below).

The exposing device 3 irradiates the surface of the photoconductive drum 1 with a laser light 3*a* based on image data of an original document read in the scanner 20 and image data transmitted from an outside device such as a personal computer (not shown). Thereby, an electrostatic latent image is formed on the surface of the photoconductive drum 1.

Figure 4:
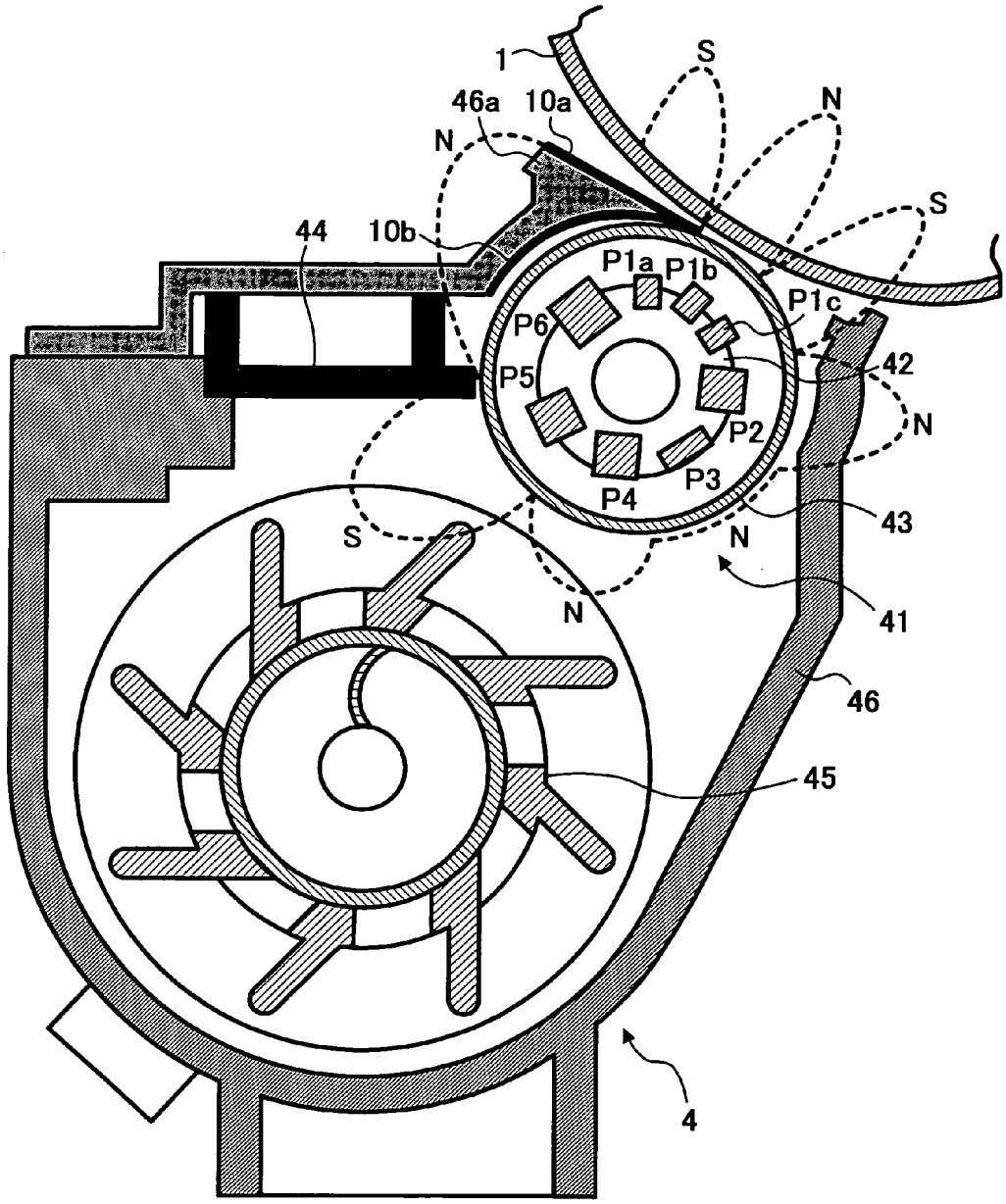
FIG. 4 is a schematic view of a developing device of FIG. 2 according to an embodiment of the present invention.

FIG. 4 is a schematic view of the developing device 4. The developing device 4 includes a developing roller 41 functioning as a developer carrier that carries a two-component developer (hereafter referred to as a "developer") including toner and magnetic carrier on the surface thereof, and a casing 46 that accommodates the developing roller 41 and the developer. The casing 46 includes an opening exposing a portion of the developing roller 41 at a position where the partial developing roller 41 faces the surface of the photoconductive drum 1 through the opening. A part of the developing roller 41 is exposed to the outside through the opening. The developing roller 41 is disposed such that a small gap is formed between the surface of the photoconductive drum 1 and the surface of the developing roller 41 exposed to the outside through the opening. The developing roller 41 includes a cylindrical-shaped developing sleeve 43 made of conductive and non-magnetic materials, and a magnet roller 42 fixed at a position inside of the developing sleeve 43. When the developing sleeve 43 is driven to rotate, the developing sleeve 43 moves relatively to the magnet roller 42, and rotates in a trailing direction with respect to the surface of the photoconductive drum 1. The developing sleeve 43 is connected to a power supply (not shown) to be applied with a developing bias. When a developing bias is applied to the developing sleeve 43, a developing electric field is formed in a developing region where the surface of the developing roller 41 faces the surface of the photoconductive drum 1. The toner in the developer carried on the surface of the developing roller 41 is adhered onto the electrostatic latent image formed on the surface of the photoconductive drum 1 by the action of the developing electric field. In the developing region, a magnetic brush including the magnetic carrier holding the toner rises on the surface of the developing roller 41 by the action of a magnetic field formed by the magnetic roller 42, and contacts the surface of the photoconductive drum 1.

The developing device 4 further includes a doctor blade 44 and a screw 45. The doctor blade 44 functions as a developer regulating member that regulates an amount of developer carried on the surface of the developing roller 41 and conveyed to the developing region. The screw 45 is configured to agitate and convey the developer accommodated in the casing 46. In the developing device 4, an entrance seal 10*a* serving as a developer scatter preventing member, and an entrance seal 10*b* serving as a toner accumulation preventing member are provided (described below).

The magnet roller 42 has a plurality of magnetic poles. Specifically, a main magnetic pole P1*b* for development causes the developer to rise in a form of a magnetic brush in the developing region. Auxiliary magnetic poles P1*a* and P1*c* are positioned at opposite sides of the main magnetic pole P1*b* and are opposite in polarity to the main magnetic pole P1*b*. A magnetic pole P4 scoops up the developer to the developing sleeve 43. Magnetic poles P5 and P6 convey the developer deposited on the developing sleeve 43 to the developing region. Magnetic poles P2 and P3 convey the developer at positions downstream of the developing region. The magnetic poles P1*a* through P6 are oriented in the radial direction of the developing sleeve 43. While the magnet roller 42 is shown as having eight poles or magnets, it may have additional poles between the magnetic pole P3 and the doctor blade 44 in order to enhance scoop-up and the ability to form a black solid image, for example, ten poles or twelve poles may be provided. In the above-described developing roller 41, the half-width of the main magnetic pole P1*b* is reduced. An angular width of the main magnetic pole P1*b* between opposite pole transition points (zero-gauss points) respectively positioned upstream and downstream of a flux density of the main magnetic pole P1*b* in the normal direction in the developer conveying direction is also reduced. Thereby, a developing nip part between the surface of the photoconductive drum 1 and the surface of the developing roller 41 can be reduced. As the developing nip part where a magnetic brush slidably contacts the surface of the photoconductive drum 1 is reduced, an occurrence of toner drift at the leading edge portion of the magnetic brush is lessened. As a result, local omission of the trailing edge of an image can be reduced.

Moreover, the auxiliary magnetic poles P1*a* and P1*c* intensify the turn-round of the magnetic lines of force issuing from the main magnetic pole P1*b*, thereby increasing the attenuation ratio of the flux density at the developing nip part in the normal direction, and forming magnetic brushes densely in the developing nip part. The main magnetic pole P1*b* included in the developing roller 41 has a strong magnetic force, and has an angular width of 60 degrees or less between opposite pole transition points (zero-gauss points) respectively positioned upstream and downstream of a flux density of the main magnetic pole P1*b* in the normal direction to the developer conveying direction. By using the magnet roller 42 in which the main magnetic pole P1*b* has a small angular width between opposite pole transition points, dense magnetic brushes are uniform at the developing nip part in the axial direction of the developing sleeve 43. Thereby, local omission of the trailing edge of an image and the thinning of horizontal lines can be lessened over the entire axial range of the developing sleeve 43.

As illustrated in FIG. 3, the transfer device 6 includes a transfer belt 6*a*, a transfer bias roller 6*b*, and a tension roller 6*c*. The transfer bias roller 6*b* includes a core metal made of, e.g., iron, aluminum, or stainless, and an elastic layer on the surface of the core metal. The transfer bias roller 6*b* is biased toward the photoconductive drum 1 with an adequate pressure by a biasing device (not shown) to bring a recording sheet as a recording material into intimate contact with the photoconductive drum 1. The transfer belt 6*a* may be made of various kinds of heat-resistant materials, such as a seamless polyimide film, as a base material. Further, a fluororesin layer may be provided on the polyimide film. If necessary, a silicone rubber layer may be provided on the polyimide film, and a fluororesin layer may be provided on the silicone rubber layer. The transfer device 6 further includes a tension roller 6*c* to drive and stretch the transfer belt 6*a*.

The fixing device 7 includes a fixing roller 7*a* including a heater (not shown) such as a halogen lamp, and a pressure roller 7*b* that press-contacts the fixing roller 7*a*. The fixing roller 7*a* includes an elastic layer made of, for example, a silicone rubber, on the surface of a core metal. The thickness of the elastic layer may be in a range of about 100 μm to about 500 μm, preferably about 400 μm. To prevent the adhesion of toner to the surface of the fixing roller 7*a* due to the viscosity of the toner, a resin surface layer made of, for example, a fluororesin, having a high toner releasing property is provided on the surface of the fixing roller 7*a*. The resin surface layer is formed from a tetrafluoroethylene-perfluoroalkyl vinyl ether copolymers (PFA) tube. It is preferable that the thickness of the resin surface layer is in a range of about 10 μm to about 50 μm in view of mechanical deterioration.

The fixing device 7 further includes a temperature detecting device (not shown) on the outer peripheral surface of the fixing roller 7*a* to detect the surface temperature of the fixing roller 7*a*. The heater of the fixing roller 7*a* is controlled such that the surface temperature of the fixing roller 7*a* is maintained in a range of about 160 to 200° C.

In the pressing roller 7*b*, an offset preventing layer made of a material, such as tetrafluoroethylene-perfluoroalkyl vinyl ether copolymers (PFA) and polytetrafluoroethylene (PTFE), covers the surface of a core metal of the pressing roller 7*b*. Like the fixing roller 7*a*, an elastic layer made of, for example, a silicone rubber, may be provided on the surface of the core metal of the pressing roller 7*b*.

As illustrated in FIG. 3, the cleaning device 8 includes a cleaning blade 8*a*, a toner collecting vane 8*d* that collects the toner scraped off the surface of the photoconductive drum 1 by the cleaning blade 8*a*, and a collecting coil 8*c* that conveys the toner collected by the toner collecting vane 8*d* to a toner container (not shown). The cleaning blade 8*a* is made of a material, such as metal, resin, or rubber. The cleaning blade 8*a* is preferably made of rubber, such as fluororubber, silicone rubber, butyl rubber, butadiene rubber, isoprene rubber, or urethane rubber. The urethane rubber may be most preferably used. The cleaning blade 8*a* is configured to remove residual toner and paper powder from the surface of the photoconductive drum 1 after the transfer process.

Figure 5:
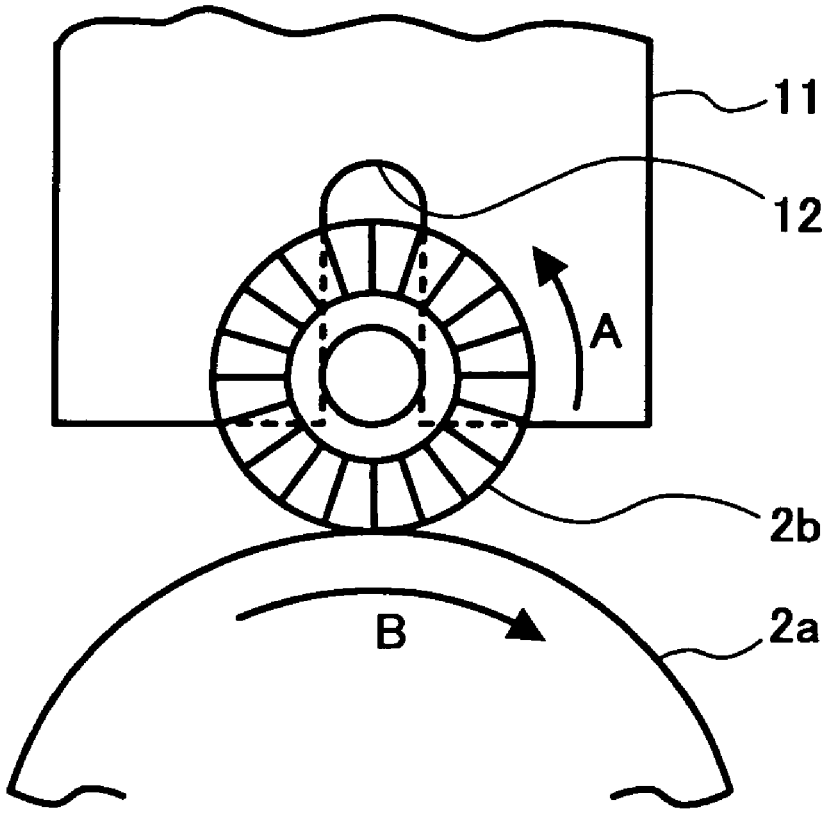
FIG. 5 is an enlarged view of a brush roller and elements around the brush roller according to an embodiment of the present invention.

Next, a conductive brush roller 2*b* of the charging device 2 will be described. FIG. 5 is an enlarged view of the brush roller 2*b* and elements around the brush roller 2*b*. The brush roller 2*b* contacts the upper surface of the charging roller 2*a* in the vertical direction. Both end portions of a shaft of the brush roller 2*b* slidably engage with guide slots 12 provided with bearing members 11, respectively. With this configuration, the brush portion of the brush roller 2*b* contacts the surface of the charging roller 2*a* due to its own weight. In this configuration, the brush portion of the brush roller 2*b* is prevented from strongly contacting the surface of the charging roller 2*a*, thereby reducing the abrasion of the surface of the charging roller 2*a*. The both end portions of the shaft of the brush roller 2*b* rotatably engage with the guide slots 12, respectively, and the brush roller 2*b* is rotated in the direction indicated by arrow A by rotating the charging roller 2*a* in the direction indicated by arrow B in FIG. 5. Therefore, a drive device for driving the brush roller 2*b* need not be provided, so that the configuration of the charging device 2 can be simplified.

The brush roller 2*b* includes a brush formed from conductive filaments. The diameter of each of the filaments is in a range of about 1 denier to about 20 denier. The length of each of the filaments is in a range of about 0.3 mm to about 2.5 mm. The density of filaments is in a range of about 7,000 filaments/cm2 to about 46,000 filaments/cm2. If the diameter of each of the filaments is less than 1 denier, the brush tends to yield when the brush contacts the surface of the charging roller 2*a* because the brush is too small. If the diameter of each of the filaments is greater than 20 denier, the brush is too thick. Therefore, the brush roller 2*b* may not have the high density of filaments in the above-described range. If the density of filaments is less than about 7,000 filaments/cm2, the number of filaments of the brush that contacts the surface of the charging roller 2*a* is small. Therefore, the surface of the charging roller 2*a* may not be efficiently cleaned, and the brush roller 2*b* may not exert high cleaning performance. If the density of filaments is greater than about 46,000 filaments/cm2, an interval between the filaments is small. In this condition, foreign substances, such as toner and paper powder that are removed from the surface of the charging roller 2*a*, may not be held in the brush roller 2*b*. Likewise, if the length of each of the filaments is less than about 0.3 mm, the brush roller 2*b* may not sufficiently hold the foreign substances. On the other hand, if the length of each of the filaments is greater than about 2.5 mm, the brush tends to yield when the brush contacts the surface of the charging roller 2*a*.

When setting each diameter, length, and density of the filaments of the brush of the brush roller 2*b* to the above-described range, the brush is prevented from yielding, so that the brush roller 2*b* can efficiently clean the surface of the charging roller 2*a*. In addition, the brush roller 2*b* can sufficiently hold foreign substances removed from the surface of the charging roller 2*a*. More preferably, the diameter of each of the filaments may be in a range of about 1.5 denier to about 2.5 denier. The length of each of the filaments may be in a range of about 1.0 mm to about 2.0 mm. The density of filaments may be in a range of about 25,000 filaments/cm2 to about 27,000 filaments/cm2.

When a charging bias is applied to the charging roller 2*a*, the potential of the conductive brush roller 2*b* becomes equal to the surface potential of the charging roller 2*a*. The foreign substances adhered onto the surface of the charging roller 2*a* carry an electric charge that is electrostatically attracted to the charging roller 2*a*. That is, the foreign substances are charged with an opposite polarity to that of the charging bias applied to the charging roller 2*a*. Such foreign substances include residual toner that has not been transferred from the photoconductive drum 1 to a recording sheet and that is charged with an opposite polarity to that of the charging bias applied to the charging roller 2*a*, as well as paper powders that are adhered onto the surface of the photoconductive drum 1 at the time of the transferring process. In this embodiment, as described above, the potential of the brush roller 2*b* is set to be equal to the surface potential of the charging roller 2*a*. By doing so, the foreign substances, which are adhered onto the surface of the charging roller 2*a*, can be mechanically and electrostatically transferred from the surface of the charging roller 2*a* to the brush roller 2*b*. Therefore, the cleaning performance of the brush roller 2*b* can be enhanced, so that the brush roller 2*b* can efficiently clean the surface of the charging roller 2*a*. To set the potential of the brush roller 2*b* to be equal to the surface potential of the charging roller 2*a*, it is preferable that the electric resistivity of the brush roller 2*b* is in a range of about $10^1$ to about $10^8$ ohms·cm.

Next, the entrance seals 10*a* and 10*b* provided in the developing device 4 will be described.

As shown in FIG. 4, the scatter of developer occurs at an upstream position in the developing region in the moving direction of the surface of the developing roller 41 where a magnetic brush of the developer rises on the surface of the developing roller 41. The developer tends to scatter at the position where the magnetic brush rises on the surface of the developing roller 41, because a balance between a centrifugal force exerted on the developer on the developing sleeve 43 and a magnetic binding force of the magnetic field generated by the magnet roller 42 is lost during a period in which the lying magnet brush rises. To prevent the developer from scattering in the image forming apparatus, the entrance seals 10*a* and 10*b* are provided in the developing device 4. The entrance seals 10*a* and 10*b* may be formed from elastic sheets made of a material, such as polyurthane (PUR) or polyethylene terephthalate (PET). Each one end portion of the entrance seals 10*a* and 10*b* is fixed to an edge portion 46*a* adjoining the opening of the casing 46 at an upstream position in the developing region in the moving direction of the surface of the photoconductive drum 1. One of the two entrance seals, e.g., the first entrance seal 10*a*, functions as a developer scatter preventing member, and is disposed such that the leading edge of the first entrance seal 10*a* contacts the surface of the photoconductive drum 1. With the first entrance seal 10*a*, a gap between the edge portion 46*a* of the casing 46 and the surface of the photoconductive drum 1 can be blocked.

Figure 6:
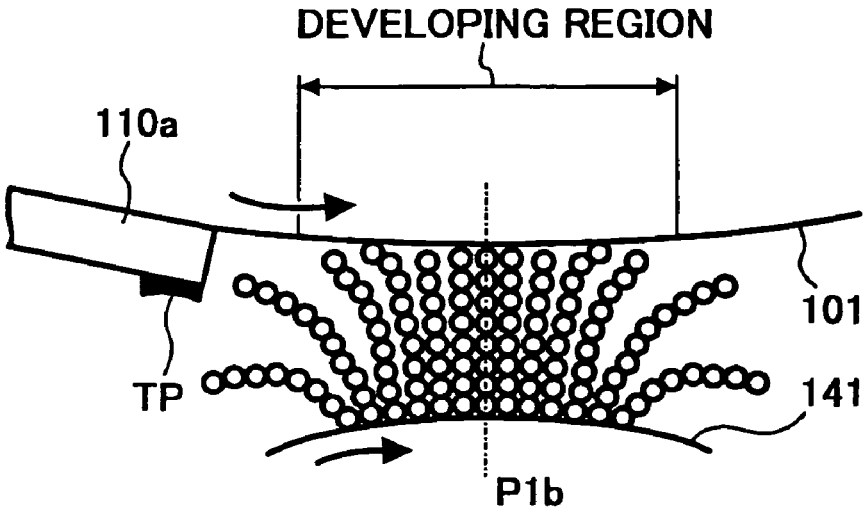
FIG. 6 BACKGROUND ART
FIG. 6 is an enlarged view of a developing region in a background copying machine.

As illustrated in FIG. 6, in many background developing devices, the first entrance seal 110*a* functioning as a developer scatter preventing member is provided, but a second entrance seal like the above-described second entrance seal 10*b* of the present invention is not provided. In this configuration, a scattered developer (mainly toner) and paper powder adhere to the surface of the first entrance seal 110*a* facing the developing roller 141, and toner and paper powder accumulate thereon. In FIG. 6, the accumulation of toner and paper powder is indicated by a reference character "TP". When an impulse is given to the accumulation of toner, agglomeration of toner falls to a developing region between the photoconductive drum 101 and the developing roller 141, thereby causing various kinds of problems.

Therefore, in this embodiment of the present invention, the second entrance seal 10*b* is used as a toner accumulation preventing member. The second entrance seal 10*b* extends from the inner wall portion of the casing 46 facing the developer that passes the doctor blade 44 and moves toward the developing region, to the position adjacent to the surface of the photoconductive drum 1. Further, the second entrance seal 10*b* is disposed such that the developer, which passes the doctor blade 44 and is carried on the surface of the developing roller 41, contacts at least a portion of the second entrance seal 10*b* by the time the developer is conveyed to the developing region. The developer is conveyed toward the developing region by movement of the surface of the developing roller 41 while rubbing against the second entrance seal 10*b*. Therefore, even if a scattered developer adheres to the surface of the second entrance seal 10*b*, the developer adhered to the surface of the second entrance seal 10*b* is collected while being rubbed by the developer conveyed by the developing roller 41. With the second entrance seal 10*b*, toner is prevented from accumulating on the surface of the first entrance seal 10*a* which faces the developer conveyed by the developing roller 41. As a result, problems caused by fallen agglomeration of toner can be lessened.

Figure 7:
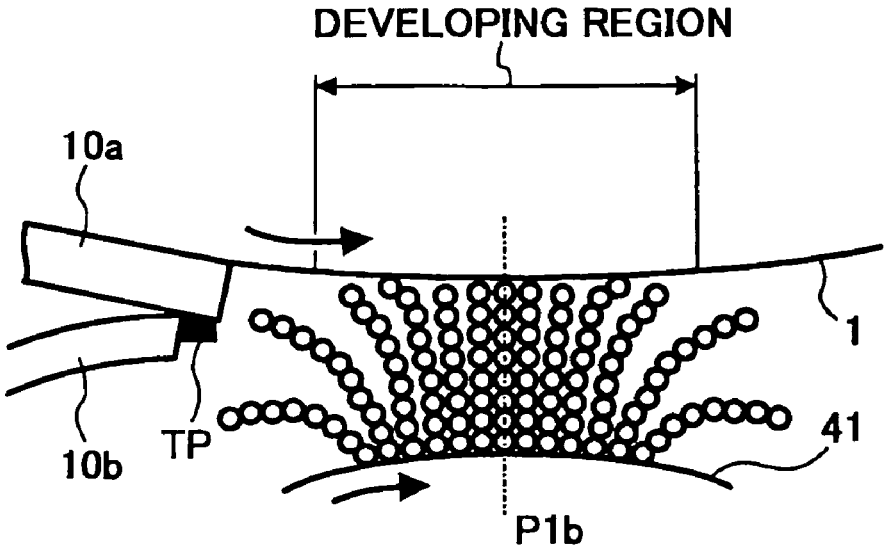
FIG. 7 is a schematic view of a leading edge of a second entrance seal located at a position further from a developing region than a leading edge of a first entrance seal according to an embodiment of the present invention.
Figure 8:
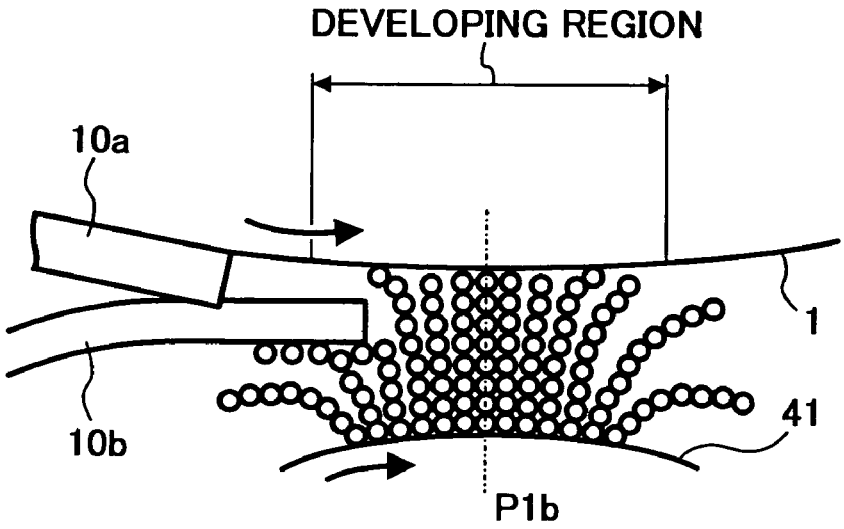
FIG. 8 is a schematic view of a leading edge of the second entrance seal located at a position within the developing region according to an embodiment of the present invention.
Figure 9:
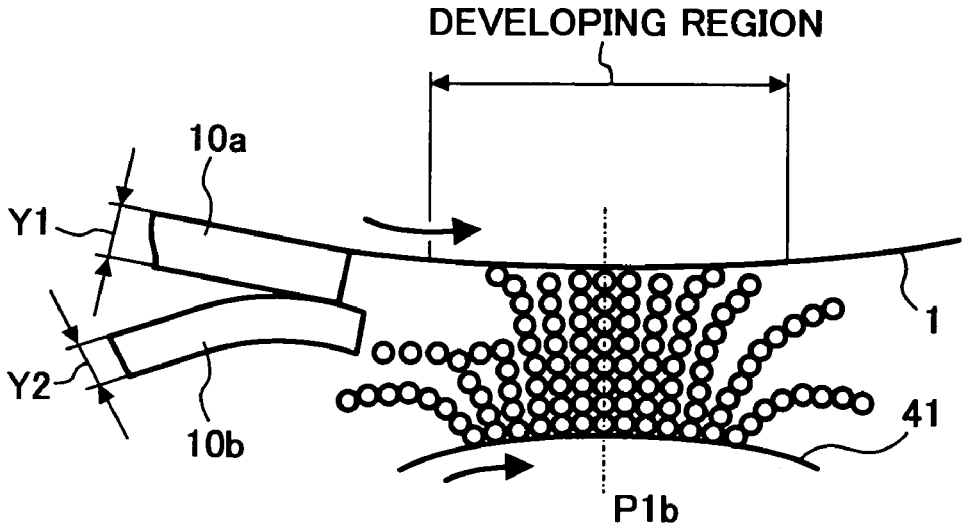
FIG. 9 is an enlarged view of a developing region according to an embodiment of the present invention.

FIGS. 7 through 9 are enlarged views of a developing region. Referring to FIG. 9, the surface of the leading edge portion of the first entrance seal 10*a* contacts the surface of the photoconductive drum 1 in a flexed condition. Further, the leading edge of the second entrance seal 10*b* is located at a position a little closer to the developing region than the leading edge of the first entrance seal 10*a*. If the leading edge of the second entrance seal 10*b* is located at a position further from the developing region than the leading edge of the first entrance seal 10*a*, as illustrated in FIG. 7, a small amount of paper powder and toner accumulate on the surface of the first entrance seal 10*a* facing the surface of the developing roller 41 with time. The accumulation of toner and paper powder is also indicated by the reference character "TP" in FIG. 7. Therefore, it is preferable that the leading edge of the second entrance seal 10*b* and the leading edge of the first entrance seal 10*a* are located at substantially the same relative positions with respect to the developing region. Alternatively, the leading edge of the second entrance seal 10*b* is preferably positioned closer to the developing region than the leading edge of the first entrance seal 10*a*. By positioning the first and second entrance seals 10*a* and 10*b* as above, the accumulation of toner on the first entrance seal 10*a* can be prevented.

However, if the leading edge of the second entrance seal 10*b* is located at a position within the developing region as illustrated in FIG. 8, the leading edge of the second entrance seal 10*b* disturbs a magnetic brush of the developer which rises in the developing region. As a result, a developing process may not be adequately performed. Further, the developer restrained by the first and second entrance seals 10*a* and 10*b* is suddenly released at the leading edge portions thereof, and simultaneously, the formation of a magnetic brush of the developer starts. In this condition, the behavior of the developer becomes unstable, and the developer tends to scatter. However, in this embodiment, the first and second entrance seals 10*a* and 10*b* are disposed at positions where each of the leading edges of the first and second entrance seals 10*a* and 10*b* does not contact a magnetic brush of the developer which rises in the developing region. By positioning the first and second entrance seals 10*a* and 10*b* as above, the behavior of the developer can be stable, and the developer scatter can be controlled.

Based on experiments performed by the present inventor, it was found that the leading edge of the second entrance seal 10*b* is preferably set to be closer to the developing region than the leading edge of the first entrance seal 10*a* by about 2 mm or less. By setting so, the accumulation of toner does not occur and an adequate development can be achieved. The conditions were as shown in Table 1:

TABLE 1

| | |
|---|---|
| Gap between the photoconductive drum 1 and the developing roller 41: | 0.4 mm |
| Scoop-up rate of developer: | 90 mg/cm2 |
| Toner particle diameter: | 6.5 μm |
| Carrier particle diameter: | 50 μm |
| Linear velocity of the photoconductive drum 1: | 330 mm/sec |
| Diameter of the photoconductive drum 1: | 100 mm |
| Ratio of linear velocity of the developing roller 41 relative to the photoconductive drum 1: | 2.0 |
| Diameter of the developing roller 41: | 25 mm |

It was found that when the linear velocity of the developing roller 41 is 250 mm/sec or less, the developer scatter does not occur in the vicinity of the developing region. However, it was also found that when the linear velocity of the developing roller 41 is greater than 250 mm/sec, the developer scatter occurs and the first entrance seal 10*a* is helpful.

The present inventor carried out experiments in which a number of copies are formed by using the above-described copying machine, and found that an image quality is deteriorated with the long use of the image forming apparatus. Through the study of the inventor, it was found that the image quality is deteriorated by the conductive brush that falls from the brush roller 2*b* and stays in a state in which the fallen conductive brush is sandwiched between the first entrance seal 10*a* and the surface of the photoconductive drum 1. When the conductive brush contacts the photoconductive drum 1 and the magnetic brush of the developer, the surface potential of the photoconductive drum 1 may be leaked toward the magnetic brush via the fallen conductive brush, and thereby an electrostatic latent image may be distorted.

In this embodiment, to prevent the above-described problem, the contact pressure of the leading edge of the first entrance seal 10*a* relative to the surface of the photoconductive drum 1 is set such that the brush that falls from the brush roller 2*b* can pass through the contact part between the leading edge of the first entrance seal 10*a* and the surface of the photoconductive drum 1 when the fallen brush is moved by movement of the surface of the photoconductive drum 1. By setting so, the brush that falls from the brush roller 2*b* can be prevented from staying at the contact part between the leading edge of the first entrance seal 10*a* and the surface of the photoconductive drum 1. Thus, the fallen brush is less likely to cause an electrostatic latent image formed on the surface of the photoconductive drum 1 to be distorted, so that deterioration of image quality can be lessened.

To realize the above-described contact pressure between the leading edge of the first entrance seal 10*a* and the surface of the photoconductive drum 1, a thickness (Y1) of the first entrance seal 10*a* and a thickness (Y2) of the second entrance seal 10*b* illustrated in FIG. 9 are each set in a range of about 0.05 mm to about 0.15 mm. If the thickness (Y1) of the first entrance seal 10*a* is less than 0.05 mm, the first entrance seal 10*a* may not be used for a long period of time due to the abrasion of the first entrance seal 10*a* by the photoconductive drum 1. Further, if the thickness (Y2) of the second entrance seal 10*b* is less than 0.05 mm, the second entrance seal 10*b* may not be used for a long period of time due to the abrasion of the second entrance seal 10*b* by the developer carried on the developing roller 41. On the other hand, if each of the thickness (Y1) of the first entrance seal 10*a* and the thickness (Y2) of the second entrance seal 10*b* is greater than 0.15 mm, the rigidity of the first and second entrance seals 10*a* and 10*b* is too great, and thereby the contact pressure of the first entrance seal 10*a* relative to the surface of the photoconductive drum 1 is too high. In this condition, the brush that falls from the brush roller 2*b* may not pass through the contact part between the leading edge of the first entrance seal 10*a* and the surface of the photoconductive drum 1, and stays at the contact part.

To confirm the effect of the above-described setting of the thickness (Y1) of the first entrance seal 10*a* and the thickness (Y2) of the second entrance seal 10*b*, the present inventor carried out experiments on image evaluation in which images are formed while changing the thickness (Y1) of the first entrance seal 10*a* and the thickness (Y2) of the second entrance seal 10*b*. In the experiments, a brush corresponding to a quarter of the circumference of the brush roller 2*b* is cut from the brush roller 2*b*, and the cut brush is attached onto the new brush roller 2*b*. Five-hundred (500) copies are made by using a copying machine including the new brush roller 2*b*. The inventor counted the number of copies having abnormal (deteriorated) images. The results are shown below in Table 2.

TABLE 2

| Thickness of entrance seal (mm) | Number of copies having abnormal images |
|---|---|
| Y1: 0.10, Y2: 0.10 | 0/500 |
| Y1: 0.10, Y2: 0.20 | 352/500 |
| Y1: 0.20, Y2: 0.10 | 103/500 |
| Y1: 0.20, Y2: 0.20 | 500/500 |
| Y1: 0.20, Y2: 0.15 | 212/500 |
| Y1: 0.15, Y2: 0.20 | 409/500 |
| Y1: 0.15, Y2: 0.15 | 150/500 |

As seen from Table 2, the number of copies having abnormal images can be decreased by reducing each thickness of the first and second entrance seals 10*a* and 10*b*. Specifically, the contact pressure between the leading edge of the first entrance seal 10*a* and the surface of the photoconductive drum 1 is reduced, to allow the brush that falls from the brush roller 2*b* to pass through the contact part, by setting each of the thickness (Y1) of the first entrance seal 10*a* and the thickness (Y2) of the second entrance seal 10*b* to be in a range of about 0.05 mm to about 0.15 mm.

Figure 10:
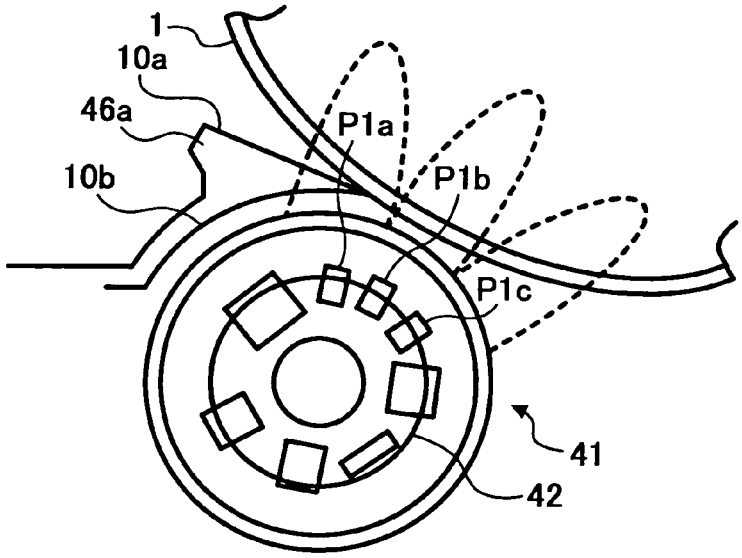
FIG. 10 is a view of a developing roller in which a main magnetic pole is positioned at a main magnetic pole angle of 0 degree according to an embodiment of the present invention.
Figure 11:
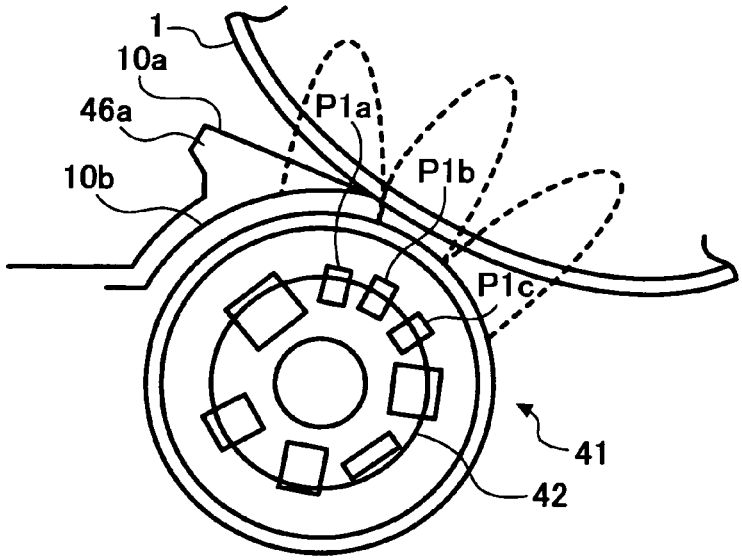
FIG. 11 is a view of a developing roller in which a main magnetic pole is positioned at a main magnetic pole angle of 6 degrees according to an embodiment of the present invention.

FIGS. 10 and 11 are views for explaining a position of the main magnetic pole P1*b* of the magnet roller 42. It is preferable that the main magnetic pole P1*b* is positioned at an angle of about 3 degrees to about 9 degrees upstream of the position where the photoconductive drum 1 and the developing roller 41 are closest to each other in the developer conveying direction.

FIG. 10 shows the mail pole P1*b* positioned at the main magnetic pole angle of 0 degree, that is, on the line connecting the center of the developing roller 41 and the center of the photoconductive drum 1. As shown in FIG. 10, if the main magnetic pole angle is 3 degrees or less, the end portions of the first and second entrance seals 10*a* and 10*b* enter the auxiliary magnetic pole P1*a*, and the magnetic brush, which rises by the action of the auxiliary magnetic pole P1*a*, contacts the photoconductive drum 1. In this condition, the magnetic brush formed by the action of the auxiliary magnetic pole P1*a* and the magnetic brush formed by the action of the main magnetic pole P1*b* rub against an electrostatic latent image formed on the photoconductive drum 1, so that the electrostatic latent image is distorted.

If the main magnetic pole P1*b* is positioned at an angle of 9 degrees or greater upstream of the position where the photoconductive drum 1 and the developing roller 41 are closest to each other in the developer conveying direction, the end portions of the first and second entrance seals 10*a* and 10*b* enter the main magnetic pole P1*b*, and intrude into the developing nip part between the photoconductive drum 1 and the developing roller 41. When the end portions of the first and second entrance seals 10*a* and 10*b* intrude into the developing nip part, the developing performance is decreased, and thereby a sufficient image density may not be obtained. Especially, in the configuration of the present embodiment in which the developing nip part is narrow, such an intrusion of the end portions of the first and second entrance seals 10*a* and 10*b* into the developing nip part greatly influences the developing performance, and the developing performance of the developing roller 41 is significantly decreased.

To address the above-described problem, as shown in FIG. 11, the leading edges of the first entrance seal 10*a* and the second entrance seal 10*b* are disposed at positions where the respective leading edges of the first entrance seal 10*a* and the second entrance seal 10*b* do not contact a magnetic brush that rises on the surface of the developing roller 41 by the action of the main magnetic pole P1*b*. Thus, it is most preferable that the end portions of the first entrance seal 10*a* and the second entrance seal 10*b* are disposed at a pole transition point between the auxiliary magnetic pole P1*a* and the main magnetic pole P1*b*.

To confirm the effect, 500 copies were produced while changing main magnetic pole angle of the main magnetic pole P1*b*, and the number of copies having abnormal images was counted. The results are shown below in Table 3.

TABLE 3

| Developing roller Main magnetic pole angle (degrees) | Number of copies having abnormal images |
|---|---|
| 0 | 130/500 |
| 3 | 1/500 |
| 6 | 0/500 |
| 9 | 2/500 |
| 12 | 156/500 |

Based on experiments, it was also found that the number of copies having abnormal images can be decreased by positioning the main magnetic pole P1*b* at an angle of about 3 degrees to about 9 degrees.

The conditions were as shown in Table 4:

TABLE 4

| | |
|---|---|
| Gap between the photoconductive drum 1 and the developing roller 41: | 0.4 mm |
| Scoop-up rate of developer: | 90 mg/cm2 |
| Toner particle diameter: | 6.5 μm |
| Carrier particle diameter: | 50 μm |
| Linear velocity of the photoconductive drum 1: | 330 mm/sec |
| Diameter of the photoconductive drum 1: | 60 mm |
| Ratio of linear velocity of the developing roller 41 relative to the photoconductive drum 1: | 2.5 |
| Diameter of the developing roller 41: | 16 mm |

In the magnet roller 42, the main magnetic pole P1*b* has an angular width of 40 degrees or less between opposite pole transition points respectively positioned upstream and downstream of the flux density of the main magnetic pole P1*b* in the normal direction in the developer conveying direction.

During an image forming process, as described above, the conductive brush fallen from the core metal of the brush roller 2*a* may be sandwiched between the first entrance seal 10*a* and the surface of the photoconductive drum 1. When the fallen brush contacts the surface of the photoconductive drum 1 and the magnetic brush of the developer carried on the surface of the developing roller 41, the surface potential of the photoconductive drum 1 may be leaked toward the magnetic brush via the fallen conductive brush, and thereby an electrostatic latent image formed on the surface of the photoconductive drum 1 may be distorted. To address this problem, in the developing device 4 of the present embodiment, the developing nip part between the surface of the photoconductive drum 1 and the surface of the developing roller 41 is made narrow, and the end portion of the first entrance seal 10*a* is disposed at a position away from the developing nip part. In this configuration, even if the fallen brush is sandwiched between the surface of the photoconductive drum 1 and the first entrance seal 10*a*, the brush does not easily contact the magnetic brush because the end portion of the first entrance seal 10*a* is away from the magnetic brush. Further, the second entrance seal 10*b* inhibits the fallen brush from contacting the magnetic brush, thereby preventing the surface potential of the photoconductive drum 1 from leaking toward the magnetic brush via the fallen brush. As a result, a distortion of an electrostatic latent image can be controlled.

To confirm the effects, the present inventor carried out accelerated tests. In the accelerated tests, each of the thickness (Y1) of the first entrance seal 10*a* and the thickness (Y2) of the second entrance seal 10*b* was set to about 0.2 mm. Further, a brush corresponding to a quarter of the circumference of the brush roller 2*b* was cut from the brush roller 2*b*, and the cut brush was attached onto the new brush roller 2*b*. Five-hundred (500) copies were produced by using a copying machine including the new brush roller 2*b*. The inventor counted the number of copies having abnormal (deteriorated) images. The results are shown below in Table 5.

TABLE 5

| Condition of developing roller | | Number of copies having black streak abnormal images |
|---|---|---|
| Background developing roller | | 500/500 |
| Developing roller of the present embodiment | Main magnetic pole angle 0 | 186/500 |
| | Main magnetic pole angle 3 | 3/500 |
| | Main magnetic pole angle 6 | 0/500 |
| | Main magnetic pole angle 9 | 3/500 |
| | Main magnetic pole angle 12 | 256/500 |

Figure 12:
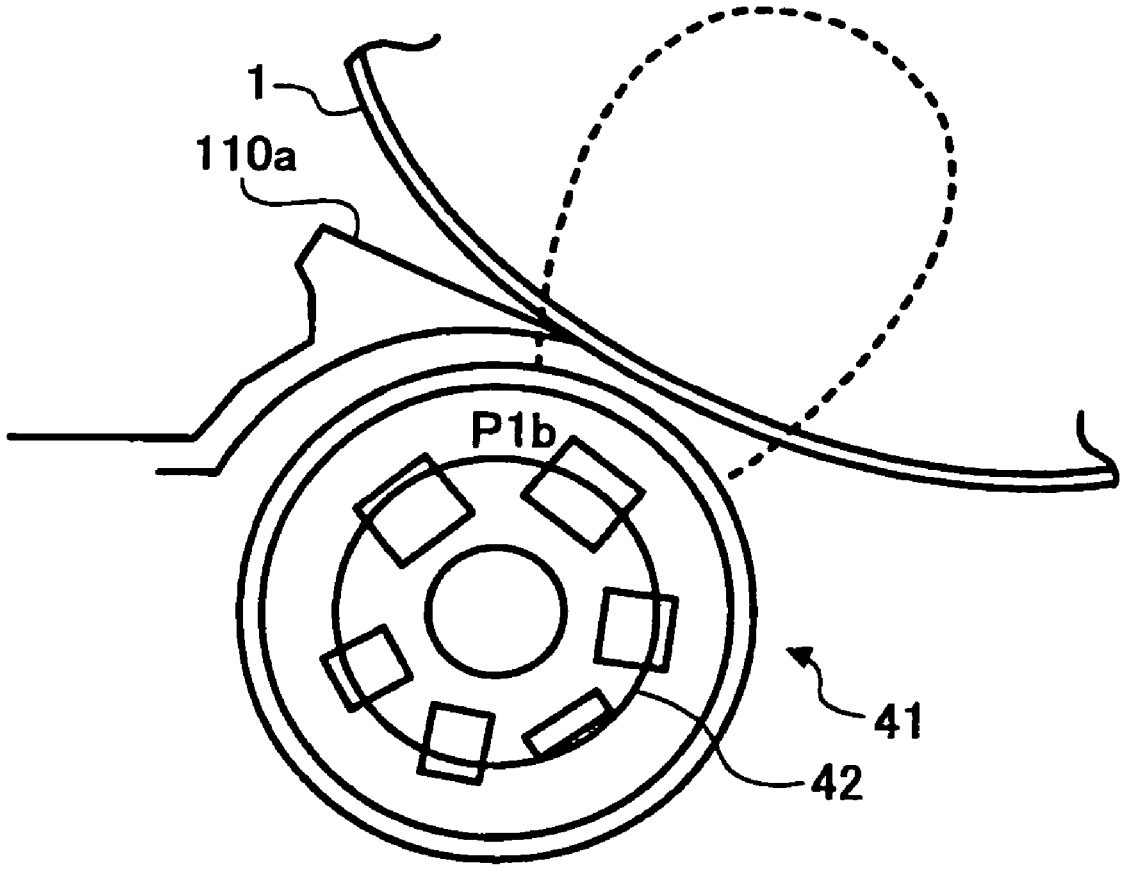
FIG. 12 BACKGROUND ART
FIG. 12 is a schematic view of a background developing roller.

The background developing roller listed in the Table 5 is shown in FIG. 12. As shown in FIG. 12, in a background developing device, the developing roller 41 includes the main magnetic pole P1*b* of the magnet roller 42 but does not include auxiliary poles adjacent to the main magnetic pole P1*b*, and the developing device has a wide developing nip part between the photoconductive drum 1 and the developing roller 41.

In the background developing device of this type, as the developing nip part is relatively wide, the first entrance seal 110*a* is brought close to the developing nip part. When 500 copies were formed by using the background developing device having a wide developing nip part, black streak images occurred in 500 copies. On the other hand, in the developing device that includes the main magnetic pole P1*b*, and the auxiliary magnetic poles P1*a* and P1*c* each adjacent to the main magnetic pole P1*b*, although the number of copies having black streak abnormal images varies depending on the main magnetic pole angle, preferable results can be obtained as a whole. Further, by positioning the main magnetic pole P1*b* at an angle of about 3 degrees to about 9 degrees upstream of the position where the photoconductive drum 1 and the developing roller 41 are closest to each other in the developer conveying direction, more preferable results can be obtained.

Similar experiments were carried out under the following conditions shown in Table 6:

TABLE 6

| | |
|---|---|
| Diameter of the photoconductive drum 1: | 100 mm |
| Ratio of linear velocity of the developing roller 41 relative to the photoconductive drum 1: | 2.0 |
| Diameter of the developing roller 41: | 25 mm |
| The main magnetic pole P1b included in the magnet roller 42 has an angular width of 60 degrees or less between opposite pole transition points. | |

In these experiments, it was found that the number of copies having abnormal images can be reduced by positioning the main magnetic pole P1*b* at an angle of about 3 degrees to about 9 degrees upstream of the position where the photoconductive drum 1 and the developing roller 41 are closest to each other in the developer conveying direction.

In the present embodiments, at least the photoconductive drum 1, the charging device 2, and the developing device 4 may be integrally assembled in an electrophotographic image forming process cartridge (not shown). The electrophotographic image forming process cartridge is detachably attached to the main body 30 of the copying machine 100 for easy maintenance. The present invention may be also applied to such an electrophotographic image forming process cartridge.

As described above, according to the embodiments of the present invention, in the copying machine 100 including the conductive brush roller 2*b* including the brush that removes foreign substances from the surface of the charging roller 2*a*, a high quality image can be formed by preventing an image deterioration caused by the conductive brush that falls from the brush roller 2*b* and by controlling the scatter of developer over a long time period.

The present invention has been described with respect to the exemplary embodiments illustrated in the figures. However, the present invention is not limited to these embodiments and may be practiced otherwise.

Numerous additional modifications and variations of the present invention are possible in light of the above teachings. It is therefore understood that within the scope of the appended claims, the present invention may be practiced other than as specifically described herein.

What is claimed is:

1. An image forming apparatus, comprising:

a latent image carrier configured to carry a latent image on a surface of the latent image carrier while moving;

a charging member configured to uniformly charge the surface of the latent image carrier, the charging member being one of in contact with and adjacent to the surface of the latent image carrier;

a conductive brush member including a brush configured to remove foreign substances from the surface of the charging member;

a developing device configured to develop the latent image carried on the surface of the latent image carrier with toner, the developing device comprising:

a developer carrier configured to carry a developer including the toner on a surface of the developer carrier while moving; and a casing configured to accommodate the developer carrier, the casing having an opening exposing a portion of the developer carrier, and having an edge portion adjoining the opening, the surface of the developer carrier exposed through the opening of the casing facing the surface of the latent image carrier in a developing region;

a developer scatter preventing member configured to prevent the developer from scattering, comprising:

a first end portion fixed to the edge portion of the casing;

a second end portion flexed on an upstream side of the developing region in a moving direction of the surface of the latent image carrier, wherein a gap between the edge portion of the casing and the surface of the latent image carrier is blocked by bringing the second end portion of the developer scatter preventing member into contact with the surface of the latent image carrier, and wherein a contact pressure of the second end portion of the developer scatter preventing member relative to the surface of the latent image carrier is set such that a brush portion, which falls from the conductive brush member and is carried on the surface of the latent image carrier, passes through a contact part between the second end portion of the developer scatter preventing member and the surface of the latent image carrier.

2. The image forming apparatus according to claim 1, wherein a thickness of the developer scatter preventing member is in a range of about 0.05 mm to about 0.15 mm.

3. The image forming apparatus according to claim 1, further comprising a toner accumulation preventing member configured to prevent the toner from accumulating, wherein the toner accumulation preventing member is disposed between the developer scatter preventing member and the developer carrier such that the developer carried on the surface of the developer carrier contacts at least a portion of the toner accumulation preventing member by the time the developer is conveyed to the developing region by movement of the surface of the developer carrier.

4. The image forming apparatus according to claim 3, wherein a thickness of the toner accumulation preventing member is in a range of about 0.05 mm to about 0.15 mm.

5. The image forming apparatus according to claim 3, wherein the toner accumulation preventing member is disposed such that a first end portion of the toner accumulation preventing member and the second end portion of the developer scatter preventing member are located at substantially same relative positions with respect to the developing region.

6. The image forming apparatus according to claim 3, wherein the toner accumulation preventing member is disposed such that a first end portion of the toner accumulation preventing member is positioned closer to the developing region than the second end portion of the developer scatter preventing member.

7. The image forming apparatus according to claim 3, wherein the developer comprises a two-component developer including toner and magnetic carrier, wherein the developer carrier includes at least one magnetic field generating device, and the two-component developer rises on the surface of the developer carrier in a form of a magnetic brush by action of a magnetic field generated by the at least one magnetic field generating device such that the two-component developer contacts the surface of the latent image carrier in the developing region, and wherein at least one of the developer scatter preventing member and the toner accumulation preventing member is disposed at a position where at least one of the second end portion of the developer scatter preventing member and the first end portion of the toner accumulation preventing member does not contact the two-component developer that rises on the surface of the developer carrier in the form of the magnetic brush in the developing region.

8. The image forming apparatus according to claim 1, wherein the brush of the conductive brush member includes filaments, and wherein a diameter of each of the filaments is in a range of about 1 denier to about 20 denier, a length of each of the filaments is in a range of about 0.3 mm to about 2.5 mm, and a density of the filaments is in a range of about 7,000 filaments/cm2 to about 46,000 filaments/cm2.

9. An image forming apparatus, comprising:

a latent image carrier configured to carry a latent image on a surface of the latent image carrier;

a charging member configured to uniformly charge the surface of the latent image carrier, the charging member being one of in contact with and adjacent to the surface of the latent image carrier;

a conductive brush member including a brush configured to remove foreign substances from the surface of the charging member;

a developing device configured to develop the latent image carried on the surface of the latent image carrier with toner, the developing device comprising:

a developer carrier configured to carry a two-component developer including the toner and magnetic carrier on a surface of the developer carrier and disposed opposite to the surface of the latent image carrier, the developer carrier including a rotary non-magnetic sleeve, and at least one magnetic field generating device having a main magnetic pole provided inside of the sleeve;

a casing configured to accommodate the developer carrier, the casing having an opening exposing a portion of the developer carrier, and having an edge portion adjoining the opening, the developer carried on the surface of the developer carrier being conveyed to the opening of the casing, and the main magnetic pole causing the developer to deposit and rise on the surface of the developer carrier in a form of a magnetic brush at the opening of the casing, such that the toner in the magnetic brush is supplied to the latent image carried on the surface of the latent image carrier;

a developer scatter preventing member configured to prevent the developer from scattering, the developer scatter preventing member being disposed at the opening of the casing on an upstream side of a region where the magnetic brush is rises on the surface of the developer carrier in a direction of conveying the developer on the surface of the developer carrier such that a leading edge of the developer scatter preventing member contacts the surface of the latent image carrier; and a toner accumulation preventing member configured to prevent the toner from accumulating, the toner accumulation preventing member being disposed between the surface of the developer carrier and the developer scatter preventing member, wherein the at least one magnetic field generating device further includes adjoining auxiliary magnetic poles disposed upstream and downstream of the main magnetic pole in the direction of conveying the developer, respectively, to adjust a half-width of the main magnetic pole, and wherein the main magnetic pole has an angular width of about 60 degrees or less between opposite pole transition points respectively positioned upstream and downstream of a flux density of the main magnetic pole in the normal direction in the direction of conveying the developer.

10. The image forming apparatus according to claim 9, wherein the toner accumulation preventing member is disposed such that a leading edge of the toner accumulation preventing member is closer to the region where the magnetic brush is rises on the surface of the developer carrier than the leading edge of the developer scatter preventing member by about 0 mm to about 2 mm.

11. The image forming apparatus according to claim 9, wherein the main magnetic pole is positioned at an angle of about 3 degrees to about 9 degrees upstream of the position where the latent image carrier and the developer carrier are closest to each other in the direction of conveying the developer.

12. The image forming apparatus according to claim 9, wherein a surface of the toner accumulation preventing member facing the developer carrier is rubbed against a magnetic brush that rises by the auxiliary magnetic pole disposed upstream of the main magnetic pole in the direction of conveying the developer, and the magnetic brush deposited on the surface of the developer carrier lies at the respective leading edges of the developer scatter preventing member and the toner accumulation preventing member.

13. The image forming apparatus according to claim 9, wherein the developer scatter preventing member and the toner accumulation preventing member are disposed at positions where the respective leading edges of the developer scatter preventing member and the toner accumulation preventing member do not contact the magnetic brush that rises on the surface of the developer carrier by action of the main magnetic pole.

14. The image forming apparatus according to claim 9, wherein the brush of the conductive brush member includes filaments, and wherein a diameter of each of the filaments is in a range of about 1 denier to about 20 denier, a length of each of the filaments is in a range of about 0.3 mm to about 2.5 mm, and a density of the filaments is in a range of about 7,000 filaments/cm2 to about 46,000 filaments/cm2.

15. An image forming apparatus, comprising:

means for carrying a latent image on a surface of the means for carrying a latent image while moving;

means for uniformly charging the surface of the means for carrying a latent image means for removing foreign substances from the surface of the means for charging;

means for developing the latent image carried on the surface of the means for carrying a latent image with toner, the means for developing comprising:

means for carrying a developer including the toner on a surface of the means for carrying a developer while moving; and means for accommodating the means for carrying a developer, means for preventing the developer from scattering, comprising:

a first end portion fixed to an edge portion of the means for accommodating; and a second end portion flexed on an upstream side of the developing region, in a moving direction of the surface of the means for carrying a latent image, wherein a gap between the edge portion of the means for accommodating and the surface of the means for carrying a latent image is blocked by bringing the second end portion of the means for preventing the developer from scattering into contact with the surface of the means for carrying a latent image, and wherein a contact pressure of the second end portion of the means for preventing the developer from scattering relative to the surface of the means for carrying a latent image is set such that a brush portion, which falls from the means for removing foreign substances and is carried on the surface of the means for carrying a latent image, passes through a contact part between the second end portion of the means for preventing the developer from scattering and the surface of the means for carrying a latent image.

16. The image forming apparatus according to claim 15, further comprising:

means for preventing toner from accumulating, wherein the developer carried on the surface of the means for carrying a developer contacts at least a portion of the means for preventing toner from accumulating by the time the developer is conveyed to the developing region by movement of the surface of the means for carrying a developer.

17. An image forming apparatus, comprising:

means for carrying a latent image on a surface of the means for carrying a latent image;

means for uniformly charging the surface of the means for carrying a latent image;

means for removing foreign substances from the surface of the means for charging;

means for developing the latent image carried on the surface of the means for carrying a latent image with toner, the means for developing comprising:

means for carrying a two-component developer including the toner and magnetic carrier on a surface of the means for carrying a two-component developer, the means for carrying a two-component developer including means for generating a magnetic field having a main magnetic pole;

means for accommodating the means for carrying a developer, the developer carried on the surface of the means for carrying a two-component developer being conveyed to an opening of the means for accommodating, and the main magnetic pole causing the developer to deposit and rise on the surface of the means for carrying a two-component developer in a form of a magnetic brush at the opening of the means for accommodating, such that the toner in the magnetic brush is supplied to the latent image carried on the surface of the means for carrying a latent image;

means for preventing the developer from scattering, the means for preventing the developer from scattering being disposed at the opening of the means for accommodating on an upstream side of a region where the magnetic brush rises on the surface of the means for carrying a two-component developer in a direction of conveying the developer on the surface of the means for carrying a two-component developer; and means for preventing the toner from accumulating, the means for preventing the toner from accumulating being disposed between the surface of the means for carrying a two-component developer and the means for preventing the developer from scattering, wherein the means for generating a magnetic field further includes adjoining auxiliary magnetic poles to adjust a half-width of the main magnetic pole, and wherein the main magnetic pole has an angular width of about 60 degrees or less between opposite pole transition points respectively positioned upstream and downstream of a flux density of the main magnetic pole in the normal direction in the direction of conveying the developer.

18. An image forming apparatus, comprising:

a latent image carrier configured to carry a latent image on a surface of the latent image carrier while moving;

a charging member configured to uniformly charge the surface of the latent image carrier, the charging member being one of in contact with and adjacent to the surface of the latent image carrier;

a conductive brush member including a brush configured to remove foreign substances from the surface of the charging member;

a developing device configured to develop the latent image carried on the surface of the latent image carrier with toner, the developing device comprising:

a developer carrier configured to carry a developer including the toner on a surface of the developer carrier while moving; and a casing configured to accommodate the developer carrier, the casing having an opening exposing a portion of the developer carrier, and having an edge portion adjoining the opening, the surface of the developer carrier exposed through the opening of the casing facing the surface of the latent image carrier in a developing region;

first and second means for preventing the developer from scattering, the first means preventing the developer from scattering in a direction conveying the developer, at a position on an upstream side of the developing region where the developer carrier faces the latent image carrier, and the second means preventing accumulation of the developer on a surface of the first means facing the developer carrier.

19. The image forming apparatus according to claim 18, wherein the brush of the conductive brush member includes filaments, and wherein a diameter of each of the filaments is in a range of 1 denier to 20 denier, a length of each of the filaments is in a range of 0.3 mm to 2.5 mm, and a density of the filaments is in a range of 7,000 filaments/cm2 to 46,000 filaments/cm2.

20. An image forming apparatus, comprising:

a latent image carrier configured to carry a latent image on a surface of the latent image carrier;

a charging member configured to uniformly charge the surface of the latent image carrier, the charging member being adjacent to the surface of the latent image carrier;

a conductive brush member including a brush configured to remove foreign substances from the surface of the charging member;

a developing device configured to develop the latent image carried on the surface of the latent image carrier with toner, the developing device comprising:

a developer carrier configured to carry a two-component developer including the toner and magnetic carrier on a surface of the developer carrier and disposed opposite to the surface of the latent image carrier, the developer carrier including a rotary non-magnetic sleeve, and at least one magnetic field generating device having a main magnetic pole provided inside of the sleeve;

a casing configured to accommodate the developer carrier, the casing having an opening exposing a portion of the developer carrier, and having an edge portion adjoining the opening, the developer carried on the surface of the developer carrier being conveyed to the opening of the casing and the main magnetic pole causing the developer to deposit and rise on the surface of the developer carrier in a form of a magnetic brush at the opening of the casing, such that the toner in the magnetic brush is supplied to the latent image carried on the surface of the latent image carrier;

first and second means for preventing the developer from scattering, the first means preventing the developer from scattering in a direction conveying the developer carrier, at a position on an upstream side of the developing region where the developer carrier faces the latent image carrier, and the second means preventing accumulation of the developer on a surface of the first means facing the developer carrier;

wherein the at least one magnetic field generating device further includes adjoining auxiliary magnetic poles disposed upstream and downstream of the main magnetic pole in the direction of conveying the developer, respectively, to adjust a half-width of the main magnetic pole, and wherein the main magnetic pole has an angular width of 60 degrees or less between opposite pole transition points respectively positioned upstream and downstream of a flux density of the main magnetic pole in the normal direction in the direction of conveying the developer.

* * * * *